US012110642B2

(12) United States Patent
Sturos et al.

(10) Patent No.: US 12,110,642 B2
(45) Date of Patent: Oct. 8, 2024

(54) MOBILE MILLING MACHINE WITH ADJUSTABLE LIQUID SPRAY SYSTEM

(71) Applicant: Caterpillar Paving Products Inc., Brooklyn Park, MN (US)

(72) Inventors: Timothy J. Sturos, Brooklyn Park, MN (US); Rolf af Klinteberg, Kallekarr (SE); Robert E. Carr, Sebastian, FL (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 0 days.

(21) Appl. No.: 17/731,793

(22) Filed: Apr. 28, 2022

(65) Prior Publication Data

US 2023/0349112 A1 Nov. 2, 2023

(51) Int. Cl.
*E01C 23/088* (2006.01)
*E01C 23/12* (2006.01)

(52) U.S. Cl.
CPC ..... *E01C 23/088* (2013.01); *E01C 23/127* (2013.01); *E01C 2301/50* (2013.01)

(58) Field of Classification Search
CPC ..... E21C 35/226; E21C 35/187; E21C 35/22; E21C 35/23; E01C 19/05; E01C 23/088; E01C 23/127; E01C 2301/50
See application file for complete search history.

(56) References Cited

U.S. PATENT DOCUMENTS

| | | | | |
|---|---|---|---|---|
| 10,640,932 | B2 | 5/2020 | Hogan et al. | |
| 2005/0168048 | A1* | 8/2005 | Gaertner | E01C 23/088 299/1.5 |
| 2007/0260379 | A1* | 11/2007 | Congdon | E02F 5/226 701/50 |
| 2008/0129103 | A1* | 6/2008 | Hall | E01C 23/088 299/39.2 |
| 2008/0267706 | A1* | 10/2008 | Hall | E01C 23/088 404/90 |
| 2013/0162003 | A1* | 6/2013 | Killion | E01C 23/088 299/1.5 |
| 2013/0249271 | A1* | 9/2013 | Killion | E01C 23/088 299/1.5 |
| 2018/0038057 | A1* | 2/2018 | Hogan | E01C 21/00 |
| 2020/0347560 | A1* | 11/2020 | Hogan | E01C 23/065 |
| 2022/0090333 | A1* | 3/2022 | Wilkens | E01C 23/088 299/1.5 |

FOREIGN PATENT DOCUMENTS

| | | | |
|---|---|---|---|
| CN | 201665813 | U | 12/2010 |
| CN | 203684052 | U | 7/2014 |
| CN | 105544365 | A | 5/2016 |
| CN | 108330793 | A | 7/2018 |

* cited by examiner

*Primary Examiner* — Janine M Kreck
*Assistant Examiner* — Michael A Goodwin

(57) ABSTRACT

A mobile milling machine can be equipped with a liquid spray system to introduce a liquid spray into a rotor enclosure to reduce the temperature of a plurality of cutting tools disposed on a rotatable cutting rotor. The liquid spray system can be associated with one or more surface wetness sensors to estimate the wetness of the work surface after the milling operation. The wetness of the work surface can be used to adjust the spray quantity of the liquid spray introduced by the liquid spray system.

17 Claims, 4 Drawing Sheets

MOBILE MILLING MACHINE WITH ADJUSTABLE LIQUID SPRAY SYSTEM

TECHNICAL FIELD

The present disclosure relates generally to the operation of a mobile milling machine for milling a work surface and more particularly relates to a system and method for controlling a liquid spray during operation of the mobile milling machine.

BACKGROUND

During road resurfacing and similar operations, an upper layer of the road surface material that is typically asphalt, pavement, or cement is removed so that a new layer of material can be deposited. Specialized mobile milling machines referred to as cold planers or road planers are used for such operations. These machines include a cutting rotor rotatably supported within a rotor enclosure on the machine frame so that the cutter rotor traverses a portion of the work surface. The cutting rotor may be a cylindrical drum-shaped structure with a plurality of cutting bits or picks disposed about the exterior surface. As the mobile milling machine travels over the work surface, the cutting rotor can be lower into and penetrate the work surface thereby fragmenting and breaking apart the top layer. In the example of a cold planer or road planer, the fragmented debris can be directed to a conveyor that removes the material and transfers it to another machine such as a haul truck leading or following the planer. In another example, a rotary mixer is a mobile milling machine that leaves the fragments and debris on the work surface so that it can be reused as aggregate.

During a milling operation, a liquid such as water is often introduced as a spray into the rotor enclosure to cool the cutting bits and to reduce the generation of dust. The water is typically carried on board the mobile milling machine in storage tanks that must be periodically refilled. Excess use of water during a milling operation therefore necessitates otherwise unnecessary refills and delays the paving operation. Another possible disadvantage of excess water use is prolonged drying times for the work surface, which may delay subsequent paving operations. Operators therefore must adjust the quantity of water used based on the operating conditions of the mobile milling machine.

U.S. Pat. No. 10,640,932 describes a system and method for automatically adjusting the quantity of water spray used in dependence on the milling operation performed by the milling machine. For example, if the mobile milling machine is performing a plunge penetration cut during which the cutting rotor is lowered into the work surface while the machine is stationary, the system may deliver a certain quantity of water whereas if the mobile milling machine is performing a milling operation during travel, the system may deliver a different quantity of water. The present disclosure is directed to a system and method for adjusting the quantity of water used during milling operations based on unique parameters and circumstances.

SUMMARY

The disclosure describes, in one aspect, a mobile milling machine for milling a work surface like a roadway covered in asphalt or pavement. The mobile milling machine includes a machine frame supported on a plurality of propulsion devices for travel over a work surface and a cutting rotor supported by the machine frame. The cutting rotor can be rotatable about a rotor axis for milling the work surface and can include a cylindrical drum with a plurality of cutting tools exteriorly disposed thereon. To accommodate the cutting rotor, a rotor enclosure is attached to the machine frame. To reduce the temperate of the plurality of cutting tools during a milling operation, a liquid spray system can be disposed in the rotor enclosure and can include a plurality of spray nozzles configured to spray a liquid toward the cutting rotor. To estimate a wetness of the work surface rearward of the cutting rotor after the milling or planing operation, one or more surface wetness sensors are operatively associated with the liquid spray system. An electronic controller can electronically communication with the surface wetness sensors and the liquid spray system and can be programmed to adjust a spray quantity of the liquid delivered by the spray system toward the cutting rotor based on the wetness of the work surface as estimated.

In another aspect, the disclosure describes a method of operating a mobile milling machine having a cutting rotor accommodated in a rotor enclosure. The method includes the steps of spraying a liquid within the rotor enclosure from a plurality of spray nozzles during a milling operation to reduce the temperature of the cutting tool on the cutting rotor. The method further involves estimating a wetness of the milled work surface with a surface wetness sensor. The wetness of the work surface can be used to adjust a spray quantity of the liquid delivered by the plurality of the spray nozzles.

In yet another aspect of the disclosure, there is described a liquid spray system for a mobile milling machine that includes a plurality of spray nozzles configured to spray a liquid toward a cutting rotor to reduce the temperature of the cutting tools thereon. The liquid spray system may also include a surface wetness sensor arranged to estimate a wetness of a work surface milled by the cutting rotor. The liquid spray system can also include an electronic controller in electronic communication with the surface wetness sensor and that is programmed to adjust a spray quantity of the liquid delivered through the plurality of spray nozzles based on the wetness of the work surface as estimated.

DETAILED DESCRIPTION

Figure 1:
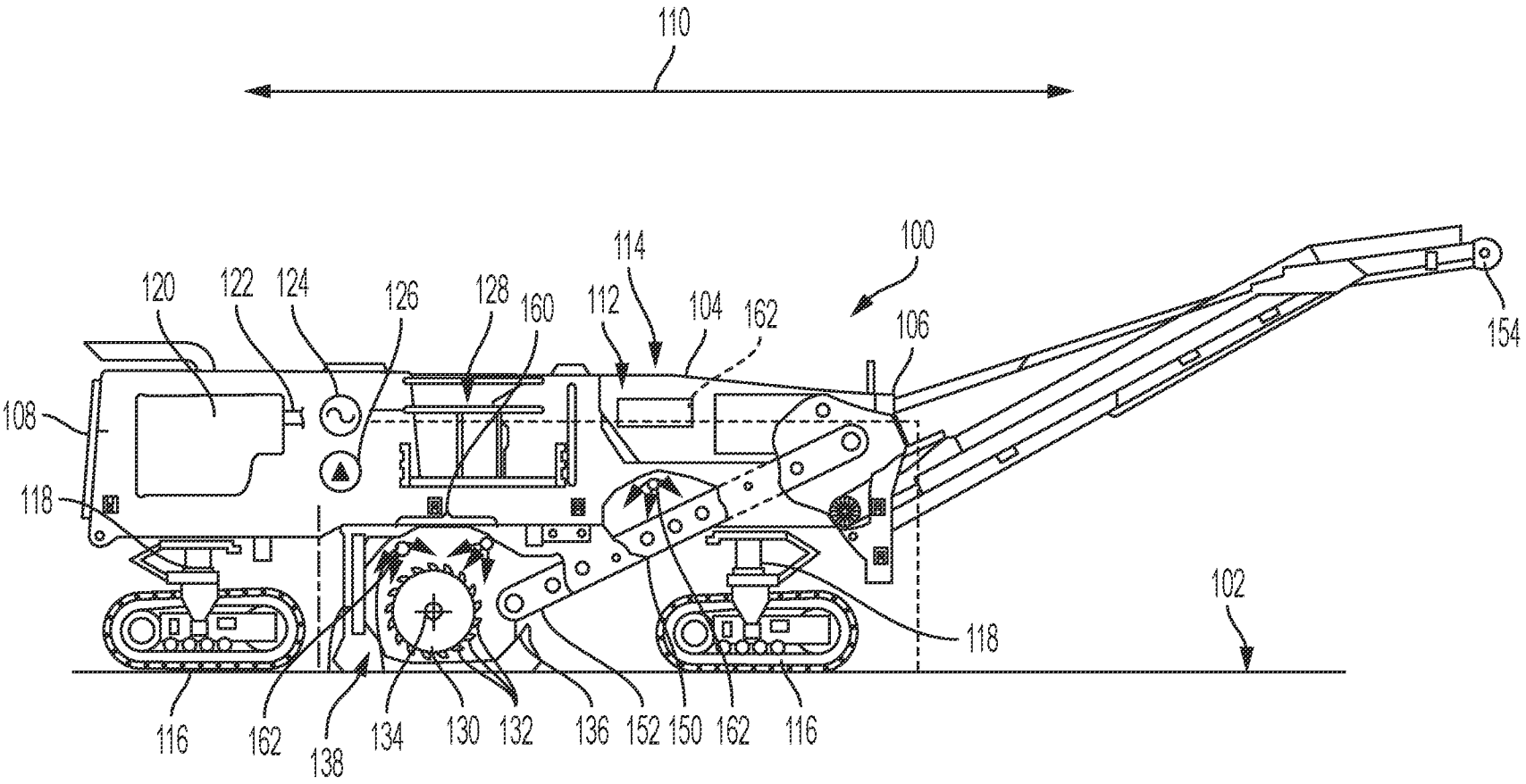
FIG. 1 is a side elevational view of a mobile milling machine for removing a layer of a work surface equipped with a cutting rotor accommodated in a rotor enclosure and a liquid spray system for spraying water or liquid proximate to the cutting rotor.

Now referring to the drawings, wherein whenever possible like reference numbers refer to like features, there is illustrated in FIG. 1 an embodiment of a mobile milling machine 100 in the particular form of a road planer or cold planer, as familiar to those of skill in the art, that are utilized in road repair and repaving operations. Such mobile milling machines are configured to remove a layer of a work surface 102 such as pavement, concrete, asphalt, or other material by penetrating into and fracturing the work surface in a milling operation. The fragmented material may be removed from the work surface 102 and new material may be deposited thereon. Although the present embodiment of the mobile milling 100 is a cold planer, aspects of the disclosure may be applicable to other machines that are used to cut and mill a work surface in the presence of a water spray or similar introduction of liquid.

The mobile milling machine 100 can include a machine frame 104 having a forward end 106 and a rearward end 108 that are aligned along a travel direction 110 of the machine. However, because the mobile milling machine 100 may operate in both forward and reverse directions, the designations used herein are for primarily for reference. In addition, the machine frame 104 can include a first lateral side 112 and an opposite second lateral side 114, which, depending upon the orientation of the observer, may correspond to the left hand side or the right hand side of the rotary mixer 100. The first and second lateral sides 112, 114 are again used herein for reference and orientation purposes and are arbitrary.

To support the mobile milling machine 100 for travel along the work surface 102, the machine frame 104 can include and be supported on a plurality of propulsion devices 116. In the illustrated embodiment, the propulsion devices 116 can be continuous tracks such as a closed belts disposed about rollers and/or sprockets where translation of the belt carries the machine frame 104 over the work surface 102. In other embodiments, the propulsion devices 116 may be rotatable wheels that include rubber pneumatic tires. In the illustrated embodiment, the mobile milling machine 100 may include four propulsion devices 116 each associated with one of the forward and rearward ends 106, 108 and the first and second lateral sides 112, 114. To vertically raise and lower the rotary mixer 100 with respect to the work surface 102, the machine frame 104 can be coupled to the propulsion devices 116 by a plurality of lifting columns 118. The telescopic lifting columns 118 can independently extend and retract to adjust the height, grade, and slope of the machine frame 104 relative to the work surface 102.

To power the propulsion components 116, lifting columns 118, and other systems of the mobile milling machine 100, a power plant such as an internal combustion engine 120 can be disposed on the machine frame 104. The internal combustion engine 120 can burn a hydrocarbon-based fuel like diesel or gasoline and convert the latent chemical energy therein to a mechanical motive force in the form of rotary motion that can be harnessed for other useful work. The rotary output of the engine 120 can be transmitted through a crankshaft 122 extending from the engine and operatively coupled directly or indirectly to the propulsion devices 116 and other systems. For example, the engine 120 can be operatively coupled to and drive power systems on the rotary mixer such as an electrical generator 124 to generate electricity for an electrical system and a hydraulic pump 126 for pressurizing and directing hydraulic fluid for a hydraulic system. The electrical or hydraulic power from the generator 124 and/or hydraulic pump 126 can be used to drive the propulsion components 116.

To accommodate an operator, the mobile milling machine 100 can include an onboard operator station 128 disposed on the machine frame 104 in a location to provide visibility over the work surface 102. The operator station 128 can include various controls, readouts, and other input/output interfaces for monitoring and controlling operation of the mobile milling machine 100. For example, the operator station 128 can include steering joysticks or steering handles for adjusting the travel direction of the mobile milling machine 100, speed controls for adjusting the travel speed of the mobile milling machine 100, and elevation controls for adjusting the vertical distance between the machine frame 104 and the work surface 102 via the lifting columns 118. In other embodiments, the mobile milling machine 100 may be configured for remote operation and some or all of the foregoing operator controls may be located remotely from the onboard operator station 128.

To engage and fragment the work surface 102, the mobile milling machine 100 can include a power driven cutting rotor 130 rotatably supported by the machine frame 104. The cutting rotor 130 can be a drum-shaped, cylindrical structure having a plurality of picks or teeth-like cutting tools 132 disposed about the exterior of its cylindrical surface. As the cutting rotor 130 rotates, the cutting tools 132 impact and penetrate into the work surface 102 fracturing the material thereof. The cutting tools 132 are adapted to penetrate into the work surface 102 and remove a portion of the material as the mobile milling machine 100 advances along the travel axis 110 through a process referred to as milling or planing. In some embodiments, the cutting tools 132 may be removable from the cutting rotor 130 for replacement as they become worn or damaged. The cutting rotor 130 can rotate about a rotor axis 134 that extends between the first and second lateral sides 112, 114 of the machine frame 104 and that is generally perpendicular to the travel direction 110.

To contain the fragmented material and debris, the cutting rotor 130 can be rotatably accommodated in a housing or rotor enclosure 136 that extends from the machine frame 104 toward the work surface 102. The rotor enclosure 136 defines an enclosed space 138 or interior volume in which the cutting rotor 130 is located. The rotor enclosure 136 can be located approximately mid-length on the machine frame 104 between the forward end 106 and the rearward end 108 so that the machine weight can be disposed on the cutting rotor 130 to maintain a uniform cut depth.

The rotor enclosure 136 may be a box like structure formed from a plurality of metal plates arranged to define the enclosed space 138. For example, referring to FIG. 2, the rotor enclosure 136 can include a first side plate 140 that is aligned with the first lateral side 112 of the rotary mixer 100 and a second side plate 142 that is aligned with the second lateral side 114 of the rotary mixer 100. The first and second side plates 140, 142 can be planar structures that are arranged vertically with respect to the machine frame 104 at the respective first and second lateral sides 112, 114 and can extend proximately toward the work surface 102. The rotor enclosure 136 can include a forward door 144 and a rearward door 146 that are arranged perpendicular to and extend between the first and second side plates 140, 142. In an embodiment, the forward door 144 and rearward door 146 are connected via hinges to the machine frame 104 so the volume of the enclosed space 138 can be adjusted. It will be appreciated that the bottom of the rotor enclosure 136 remains open so that the cutting rotor 130 can protrude from the enclosed space 138 and contact the work surface 102.

To remove fragmented material in the embodiments where the mobile milling machine 100 is a cold planer, referring back to FIG. 1, a conveyor system 150 may be disposed through the machine frame 104 and extend forwardly from the forward end 106. An intake end 152 of the conveyor system 150 can access the rotor enclosure 136 forwardly of the cutting rotor 130 and proximate to the work surface 102. During rotation of the cutting rotor 130, the fragmented material can be directed to the intake end 152 of the conveyor system 150 and deposited on the conveyor belt for transfer forwardly to a discharge end 154 of the conveyor system 150. The discharge end 154 can be located forwardly of the mobile milling machine 100 and elevated above the work surface 102 so that a haul truck can be located thereunder to receive the discharged material. In an embodiment, the pattern or arrangement of the cutting tools 132 on the cutting rotor 130 can be configured to direct the fragmented material toward the intake end 152 of the conveyor system 150.

During a milling or planing operation, the repeated impact and penetration of the cutting tools 132 into the work surface 102 as the cutting rotor 130 rotates generates heat as a result of friction. The amount of heat generated will in part be determined by the abrasiveness or hardness of the material on the work surface 102 and the speed of the operation, for example, as determined by travel speed of the mobile milling machine 100 or the rotational speed of the cutting rotor 130. Excessive heat may adversely affect the operational life of the cutting tools 132 requiring more frequent replacement of the cutting tools. Excessive heat may also adversely affect other aspects of the mobile milling machine 100 such as premature degradation of lubricant. In addition to heat, the milling or planning operation generates dust as the cutting tools fragment the work surface 102. Accordingly, to reduce heat generation and to mitigate dust creation, the mobile milling machine 100 may include a liquid spray system 160 to deliver liquid such as water as a spray to the enclosed space 138 of the rotor enclosure 136.

Figure 2:
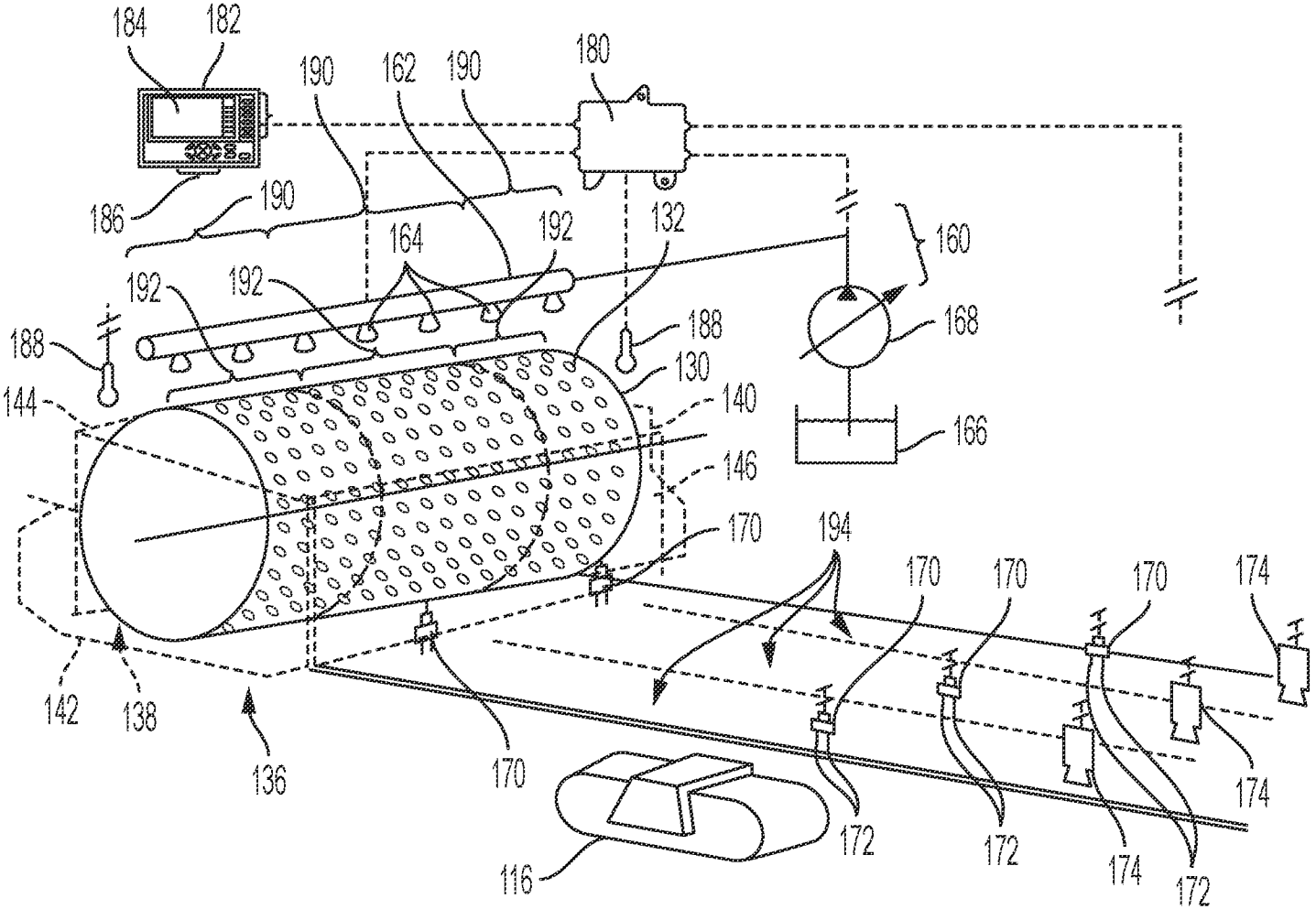
FIG. 2 is a schematic representation of the liquid spray system and related components to adjustably control the quantity of liquid introduced in accordance with the disclosure.

In an embodiment illustrated in FIGS. 1 and 2, the liquid spray system 160 can include one or more spray bars 162 that are located in the interior volume 138 defined by the rotor enclosure 136. The spray bars 162 may be elongated pipes or tubes and can include a plurality of spray nozzles 164 that direct a liquid spray toward or proximately to the cutting rotor 130. The water or other liquid delivered to the cutting rotor 130 can reduce the heat of the cutting tools 132 and other surfaces of the cutting rotor 130 through evaporative cooling as well as remove dust and other fines present in the rotor enclosure 136.

In an embodiment, the spray bars 162 can be arranged generally in parallel to the rotor axis 134 of the cutting rotor and can located generally above the cutting rotor to direct the liquid spray thereon. Moreover, a plurality of spray bars 162 can be included both forward and rearward of the cutting rotor 130. The spray bars 162 may be axially coextensive with the cutting rotor 130 to ensure the exterior surface of the cutting rotor receives an adequately quantity of liquid spray. In an embodiment, rather than a single spray bars 162 extending coextensive with the axial length of the cutting rotor, the spray bars 162 can be segmented into a plurality of laterally aligned spray bars parallel to the rotor axis of the cutting rotor. In another embodiment, for further dust control, one or more spray bars 162 and associated spray nozzles 164 can be disposed along the conveyor system 150. To supply water or other liquid for the liquid spray system 160, a fluid retention tank or liquid reservoir 166 can be disposed onboard on the machine frame 104 and which can deliver the water or liquid to the spray bars 162 via a liquid pump 168.

Although introduction of a liquid spray in the presence of the cutting rotor 130 assists in reducing the temperature of the cutting tools 132, excess introduction of the liquid spray may be disadvantageous. For example, if the quantity of the liquid spray is too great, the liquid reservoir 166 will be quickly depleted and necessitate refilling more often, which may slow or delay the road working operation. In addition, excess introduction of the liquid spray may result in the formation of puddles of the liquid on the work surface 102 that may remain as the mobile milling machine 100 travels along the travel direction 110 that may be detrimental to or delay subsequent road working operations.

Therefore, to estimate whether the quantity of liquid spray introduced by the liquid spray system 160 is excessive, the liquid spay system may be associated with one or more surface wetness sensors 170. The surface wetness sensors 170 can be disposed on the machine frame 104 of the mobile milling machine 100 at locations that enable the surface wetness sensor 170 to measure or estimate the quantity of water or other liquid remaining on the work surface 102 after the liquid spray system 160 has introduced the liquid spray to the rotor enclosure 136. For example, the one or more surface wetness sensors 170 can be disposed on the rearward door 146 of the rotor enclosure 136, which may be referred to as or associated with a moldboard that can contact the work surface 102 to smooth or level piles of material fragment left on the work surface 102 by the cutting or planing operation. In other embodiments, the one or more surface wetness sensors 170 can be located further rearward of the rotor enclosure 136 toward the rear end 108 of the machine 104, for example, behind the rearward propulsion device 116, which may allow for a degree of evaporation to occur prior to the surface wetness sensors 170 attempting to measure the wetness remaining on the work surface 102

The surface wetness sensors 170 may operate based on any suitable technique or technical principle for estimating the wetness or similar condition of a surface. For example, the surface wetness sensors 170 may be conductivity sensors that utilize electrical conductivity to estimate the wetness of a surface. The conductivity sensor may include at least two exposed electrodes 172 that are spaced apart from each other and that are configured to physically contact the work surface 102. The conductivity sensors may be associated with a source of electricity like a battery or generator so that a voltage is applied between the spaced-apart electrodes 172. If a sufficient amount of water or other liquid remains on the work surface 102 behind the rotor enclosure 136, the electrodes 172 will be able to pass an electrical current between themselves via contact with the water or liquid resulting in a measurable conductivity. The measured value of the conductivity between the electrodes 172 can be used to estimate the quantity of water or other liquid on the work surface 102. In the absence of any remaining liquid on the work surface 102, e.g., a dry work surface, the spaced apart electrodes 172 are electrically isolated and no conductivity will be measured.

In another example, the surface wetness sensors 170 may operate in a non-contacting manner. For example, the surface wetness sensors 170 may be optical or infrared sensors 174 that are disposed in a direction toward the work surface 102 but are spaced there from. The optical or infrared sensor 174 can direct a beam of visible or infrared light toward the work surface 102 and can receive the reflected light. The wavelength of the reflected light can be analyzed to determine or estimate the quantity of water or liquid remaining on the work surface 102 after the cutting or milling operation. In another example, the surface wetness sensors 170 can be a non-contacting sensor such as a camera that captures an image of the work surface 102 and that can use an image analysis algorithm to estimate the quantity of liquid there on.

In another possible example, the surface wetness sensor 170 can also be disposed within rotor enclosure 136 and can be a humidity sensor that measures the humidity within the enclosed space 138 defined by the rotor enclosure. The humidity can be used to indirectly estimate the resulting quantity of water or liquid that will remain on the work surface. In yet another possible example, the surface wetness sensor 170 can be located along the conveyor 150 that extends forwardly of the rotor enclosure 136 and can disposed to contact the fragmented material transported by the conveyor belt to sense the dampness or wetness of the material, which can be indicative of the quantity of water or liquid introduced by the liquid spray system 160 and further indicative of the wetness of the work surface 102 after the milling operation.

To process the information obtained by the one or more surface wetness sensors 170, the surface wetness sensors 170 can electronically communicate with an electronic controller 180. The electronic controller 180 can be embodied as a microprocessor, a central processing unit, an application specific integrated circuit (ASIC) or the like. The electronic controller 180 can include appropriate circuitry, including multiple integrated transistors for carrying out computing functions. For example, the electronic controller 180 can be capable of receiving data and instructions, executing or processing that information, and outputting the results. In the illustrated embodiment, the electronic controller 180 may be a single, discrete unit and may be located onboard the mobile milling machines 100. In other embodiments, the electronic controller 180 may be distributed among a plurality of distinct and separate components.

The electronic controller 180 can communicate with one or more surface wetness sensors 170 by sending and receiving electronic data signals as indicated by dashed lines. To process the data information received from the surface wetness sensors 170, the electronic controller 180 can be programmed to estimate the quantity of water or other liquid remaining on the work surface 102. For example, the electronic controller 180 can determine and process the conductivity measured via the electrodes 172 or can utilize the wavelength detected by the optical or infrared sensors 174.

The electronic controller 180 can be operatively associated with an interface device 182 to convey the estimated surface wetness to an operator of the mobile milling machine 100. The interface device 182 can include a visual display 184, such as a LCD display, that can present a visual representation to the operator of the estimated quantity of the surface wetness. By way of example, the level of surface wetness can be represented by a numerical or color indicative scale. The interface device 182 may also include one or more input devices 186, such as buttons dials or switches, that the operator may use to adjust the quantity of liquid spray delivered by the spray system 160 based on the estimated quantity of moisture remaining on the work surface 102.

To adjust the quantity of liquid spray, the liquid spray system 160 can be configured in any suitable manner to restrict or increase the flow of water or liquid there through. For example, the liquid pump 168 can be a variable volume pump in which the displacement can be changed or adjusted via a swash plate to change or adjust the throughput. Alternatively, the liquid pump 168 can be operatively associated with a viable speed motor or stepper motor to increase or decrease the pumping speed. In another example, the plurality of spray nozzles 164 on the spray bars 162 may be adjustable nozzles that can be opened or closed in various degrees to change the volume of liquid spray introduced into the rotor enclosure 136.

In a possible embodiment, to better control the quantity of liquid spray introduced to reduce the temperature of the cutting tools 132, the liquid spray system 160 can be operated in conjunction with another system configured to estimate the temperature of the cutting tools disposed on the exterior of the cutting rotor 130. For example, the temperature system may include one more temperature sensors 188 configured to determine the temperature of or proximate to one or more of the cutting tools 132 and can communicate that information by sending and receiving data signals to the electronic controller 180. The temperature sensor 188 can measure or estimate the temperature of the cutting tools 132, either indirectly or directly, in any suitable manner. For example, the temperature sensors 188 can be located inside the rotor enclosure 136 and measure the temperature therein to indirectly estimate the temperature of the exterior of the cutting rotor 130. Alternatively, the temperature sensors 188 can be contact sensors and can use thermo-electrical resistivity to directly sense the temperature of the cutting tools 132 to which they are physically associated.

In another possible embodiment, the elongated spray bar 162 can be segmented into a plurality of distinct lateral spray zone 190 and the elongated cutting rotor 130 can be similarly segmented into a plurality of distinct cutting zones 192 spaced along the rotor axis 134. The spray zones 190 and the cutting zones 192 can be laterally coextensive so that each spray zone is operatively and individually associated with one of the cutting zones and can direct a liquid spray proximately towards that individual zone. The distinct cutting zones 192 can be associated with different patterns of the cutting tools 132 on the cutting rotor 130.

To individually activate a particular spray zone 190 to direct spray to a particular cutting zone 192, the one or more surface wetness sensors 170 can be arranged in a plurality of surface sensing zones 194. For example, the plurality of surface wetness sensors 170 can be arranged in a spaced apart manner laterally across the work surface 102 and aligned with one of the cutting zones 192. Each of the surface wetness sensors 170 can estimate the surface wetness of that particular surface sensing zone 194 resulting from a particular cutting zone 192 of the cutting rotor 130. The electronic controller 180 can use the surface wetness measured by the individual surface wetness sensors 170 to individually adjust the plurality of spray zones 190 of the spray bar 162. Segmenting the spray bar 162 into a plurality of spray zones 190 that can be individually adjusted with respect to measurements from surface wetness sensors 170 that are associated with corresponding surface sensing zones 194 enables the liquid spray system 160 to better control the quantity of liquid used.

Figure 3:
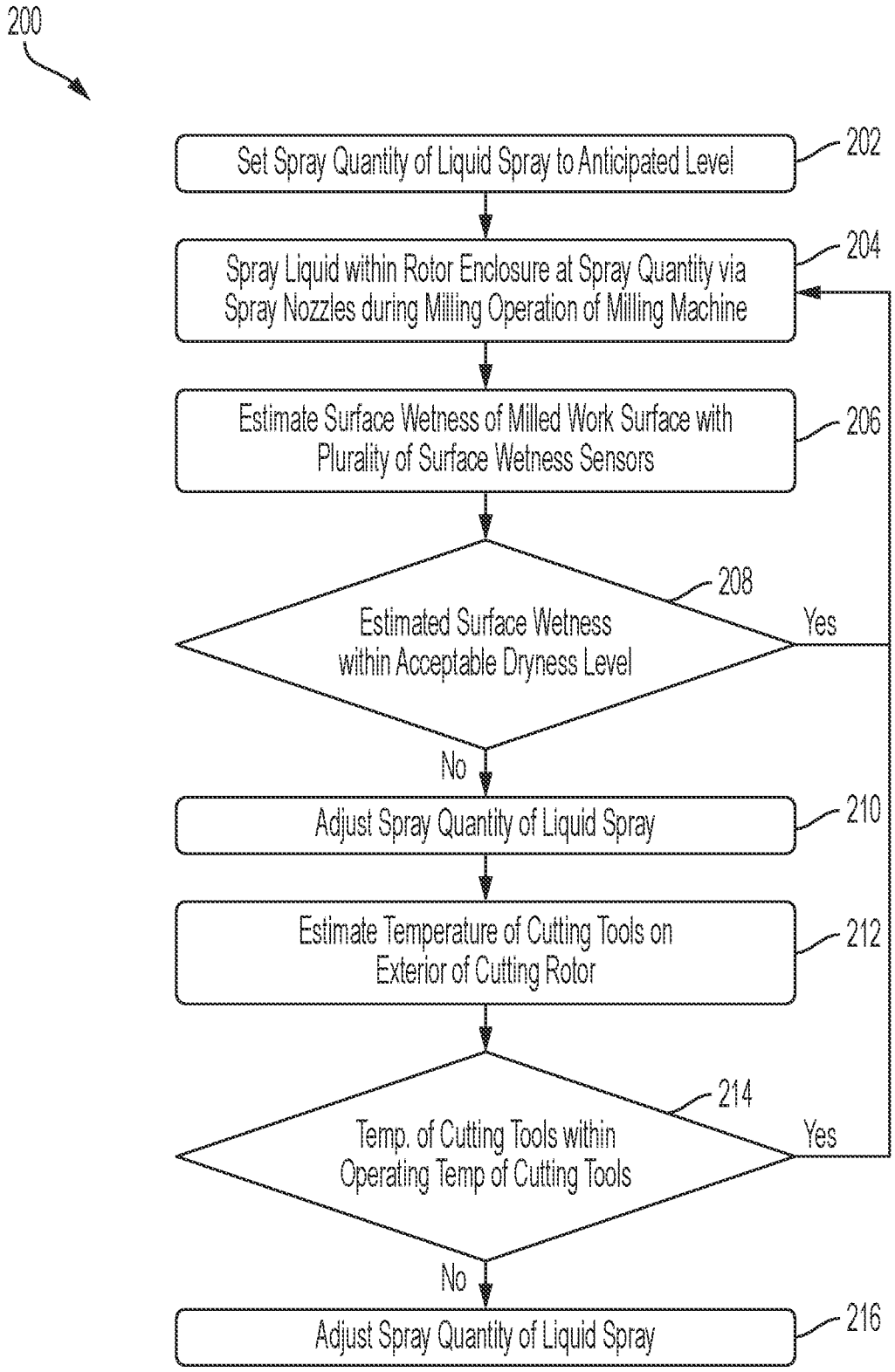
FIG. 3 is a schematic flow chart of a computer implemented method by which the liquid spray system may adjust the quantity of liquid introduced to the cutting rotor based on measured parameters.

Referring to FIG. 3, with continued reference to the preceding figures, there is illustrated a possible process by which the liquid spray system 160 can responsively adjust the quantity of liquid introduced to, for example, the rotor enclosure 136 to optimize the quantity of liquid used during a milling operation. In an embodiment, the process 200 depicted in FIG. 3 may be conducted automatically by the electronic controller 180 associated with the liquid spraying system 160 without input from an operator of the mobile milling machine 100, or may be used to assist an operator by providing appropriate guidance. Accordingly, the process 200 may be embodied as a series of non-transitory computer readable instructions written in in an appropriate software language that the electronic controller 180 can read and execute.

In an initial set spray quantity step 202, the operator may set the quantity of water or liquid for the liquid spray system 160 to introduce to the rotor enclosure 136 to an anticipated level. The anticipated level may be based on factors such as the ambient temperature and condensation conditions, the hardness of the material to be milled, operational rating and design of the cutting tools 132, and other factors. In a spraying step 204 during a milling operation, the liquid spraying system 160 can introduce the liquid spray to the rotor enclosure 136 to reduce the temperature of the plurality of cutting tools 132 exteriorly disposed on the cutting rotor 130. For example, the liquid may be introduced via a plurality of spray nozzles 164 fluidly connected via one or more spray bars 162 within or proximate to the rotor enclosure 136.

To determine if the quantity of liquid introduced is excessive, in a surface wetness-sensing step 206, one or more surface wetness sensors 170 can be used to estimate the wetness of the work surface 102 after milling. For example, the surface wetness sensors 170 can be located on the machine frame 104 behind the cutting rotor 130 and can sense the wetness directly or indirectly as described above. In a comparison step 208, the estimated quantity of the surface wetness can be compared to an acceptable dryness quantity. The acceptable dryness quantity may correspond to or reflect an acceptable level of liquid remaining on the work surface 102 behind the rotor enclosure 136 and can be based on a number of factors including, for example, liquid conservation.

Based on the comparison step 208, the electronic controller 180 can adjust the spray quantity of the liquid spray introduced by the liquid spraying system 160 in an adjustment step 210. For example, if the spray quantity of the liquid spray exceeds the acceptable dryness quantity, indicating an excessive amount of water or liquid is being introduced, the electronic controller 180 can reduce the spray quantity by, for example, adjusting operation of the liquid pump 168 or adjusting the flow through adjustable spray nozzles 174. If the estimated surface wetness is within the acceptable dryness quantity, the process 200 may return to spraying step 204.

In a further embodiment, the process 200 may sense and utilize other parameters associated with the milling operation to further adjust and optimize the quantity of liquid introduced to the cutting rotor 130 via the spray system 160. For example, in a temperature estimation step 212, the electronic controller 180 can estimate the temperature of the cutting tools 132 using the one or more temperature sensors 188 operatively associated therewith. As described above, the temperature sensors 188 can be configured to directly or indirectly sense the temperature of the cutting tools 132. In a second comparison step 214, the estimated temperature of the cutting tools 132 can be compared with an operating temperature of the cutting tools. The operating temperature of the cutting tools 132 can be a rated operating temperature based on the material of the cutting tools and the desired operational or useful life.

Based on the second comparison step 214, the electronic controller 180 can adjust the spray quantity of the liquid spray introduced by the liquid spraying system 160 in a second adjustment step 216. For example, if the temperature of the cutting tools 132 exceeds the operating temperature, indicating that a further reeducation in temperature is desired, the spraying system 160 can increase the spray quantity of the liquid spray introduced to the rotor enclosure 136. Conversely, if the temperature of the cutting tools 132 is below the operating temperature, the spraying system 160 can further reduce the spray quantity to conserve liquid.

INDUSTRIAL APPLICABILITY

Figure 4:
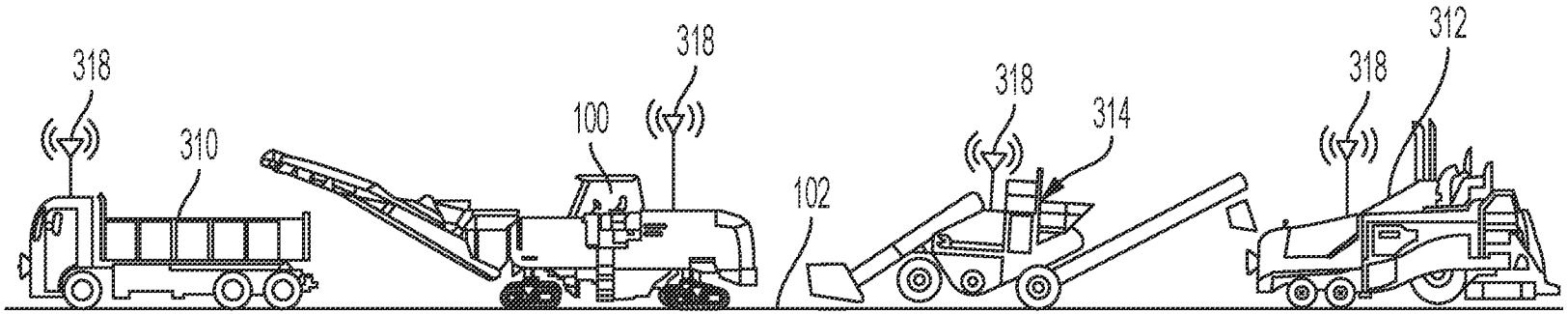
FIG. 4 is a side elevational view of an example of a road working operation including a plurality of mobile machines operating in proximity in which the disclosed liquid spray system may be applicable.

Referring to FIG. 4, there is illustrated a particularly applicable application of the disclosed spraying system 160 used on a mobile milling machine 100 cooperatively operating with a plurality of other mobile machines in a road paving operation. An advantage of using a plurality of mobile machines in cooperative operation is to quickly begin and complete the complete the paving process in an expedited manner. In such a paving operation, the plurality of mobile machines may be aligned in a paving convoy or paving train 300 and may travel in tandem in a common travel direction 302. Each mobile machine may have a dedicated task that may be dependent upon the performance of the machine ahead of it. For example, in addition to the mobile milling machine 100 to mill the work surface 102, the paving train 300 can include a haul machine 310 such as a dump truck to haul material to and from the work site. Another example of a mobile machine may be a paver 312 for laying a paving material onto the work site. In particular, a paver 312 receives paving material into a forward hopper and deposits that maternal onto the work surface 102 that may have been recently milled by the mobile milling machine 100. In addition, to transfer material to the paver 312, another example of a mobile machine may be a material transfer vehicle 414 or MTV.

Because the plurality of mobile machines must operate in a continuous and coordinated manner, the operation and relative locations, spacing, and distance between the machines must be coordinated and controlled. Accordingly, each mobile machine may be operatively associated with a transmitter/receiver 318 using any suitable communications technology such as radio, WiFi, connected area networks, cellular networks, Bluetooth, infrared communications, and the like.

The disclosed liquid spraying system 160 may find particular applicability in a paving train 300 of the foregoing type because it can ensure the surface wetness of the work surface 102 is optimized to so that the other mobile machines can conduct their designated tasks. For example, if the surface wetness is excessive, the paving operation of a following paver 312 will be delayed as the work surface 102 dries. Another example of a task that may be delayed or hindered includes a sweeper or the like that sweeps away or removes fragmented material, which may retain excessive weight due to the retained liquid. These circumstances may be exacerbated at night when there is no sunlight to assist in the drying process and the lack of light may make it difficult to visibly assess the surface wetness of the work surface 102.

The process disclosed in FIG. 3 above can address the above concerns by, for example, automatically adjusting the spray quantity of the liquid spray to reduce the surface wetness while periodically or continuously estimating the temperature of the cutting tools 132 so they remain within the rated operating temperature of the cutting tools. In a possible further embodiment, the process 200 conducted by the electronic controller 180 may further utilize the communicative capabilities between the mobile machines equipped with transmitter/receivers 318 in the paving train 300. For example, the transmitter/receivers 318 or a similar distance-sensing device can determine or measure the distance between the mobile milling machine 100 and the following mobile machines such as a paver 312. That distance can be an input factor used to determine the acceptable dryness level in the first comparison step 202 of the process. The electronic controller 180 can adjust the spray quantity introduced by the liquid spraying system 160 so that the surface wetness of the work surface 102 remaining after the milling operation will be sufficiently dry by evaporation when the paver 312 reaches the same location. Moreover, the liquid spraying system 160 can responsively adjust the surface wetness as the distance between the mobile milling machine 100 and paver 312 changes.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

We claim:

1. A mobile milling machine comprising:

a machine frame supported on a plurality of propulsion devices for travel over a work surface;

a cutting rotor supported by the machine frame and rotatable about a rotor axis for milling the work surface, the cutting rotor includes a cylindrical drum and a plurality of cutting tools exteriorly disposed on the cylindrical drum;

a rotor enclosure attached to the machine frame and accommodating the cutting rotor therein;

a liquid spray system disposed in the rotor enclosure and including a plurality of spray nozzles configured to spray a liquid toward the cutting rotor;

a surface wetness sensor disposed rearward of a rearward propulsion device and operatively associated with the liquid spray system; and an electronic controller in electronic communication with the surface wetness sensor and the liquid spray system, the electronic controller in cooperation with the surface wetness sensor is configured to determine a wetness of the work surface rearward of the cutting rotor after milling the work surface, the electronic controller programmed to compare the wetness of the work surface as determined after milling with an acceptable dryness quantity and to adjust a spray quantity of the liquid delivered by the liquid spray system toward the cutting rotor if the wetness of the work surface as determined after milling exceeds the acceptable dryness quantity.

2. The mobile milling machine of claim 1, wherein the surface wetness sensor is one or more of an optical sensor, an infrared sensor, and a conductivity sensor.

3. The mobile milling machine of claim 2, wherein the machine frame includes a front end and a rear end, and the surface wetness sensor is disposed on the machine frame rearward of the cutting rotor.

4. The mobile milling machine of claim 1, wherein the surface wetness sensor is disposed on a moldboard of the rotor enclosure.

5. The mobile milling machine of claim 1, wherein the liquid spray system includes a variable volume pump and the electronic controller adjusts the variable volume pump to adjust the spray quantity of the liquid.

6. The mobile milling machine of claim 1, wherein the plurality of spray nozzles are adjustable spray nozzles and the electronic controller adjusts the adjustable spray nozzles to adjust the spray quantity of the liquid.

7. The mobile milling machine of claim 1, wherein the plurality of spray nozzles are disposed along one or more spray bars that are aligned generally parallel with the rotor axis.

8. The mobile milling machine of claim 7, wherein the one or more spray bars are generally coextensive with the cylindrical drum.

9. The mobile milling machine of claim 8, wherein the one or more spray bars are segmented into a plurality of spray zones and the surface wetness sensor includes a plurality of surface wetness sensors with at least one of each of the plurality of surface wetness sensors operatively aligned with at least one of each of the plurality of spray zones.

10. The mobile milling machine of claim 1, further comprising a temperature sensor configured to determine a temperature of the plurality of cutting tools and the electronic controller in electronic communication with the temperature sensor.

11. The mobile milling machine of claim 1, wherein the surface wetness sensor and the electronic controller determines the wetness of the work surface through direct contact.

12. The mobile milling machine of claim 1, wherein the surface wetness sensor and the electronic controller determines the wetness of the work surface without direct contact.

13. A method of operating a mobile milling machine having a cutting rotor accommodated in a rotor enclosure, the method comprising:

spraying a liquid within the rotor enclosure from a plurality of spray nozzles during a milling operation to mill a work surface;

determining a wetness of the work surface rearward of the cutting rotor after milling with a surface wetness sensor in cooperation with an electronic controller;

comparing the wetness of the work surface as determined after milling with an acceptable dryness level associated with the work surface, wherein the acceptable dryness level is based at least in part on a distance between the mobile milling machine and a second mobile machine; and adjusting a spray quantity of the liquid if the wetness of the work surface as determined after milling exceeds the acceptable dryness level.

14. The method of claim 13, wherein the surface wetness sensor and the electronic controller determines the wetness of the work surface through direct contact.

15. The method of claim 13, wherein the surface wetness sensor and the electronic controller determines the wetness of the work surface without direct contact.

16. The method of claim 13, further comprising:

determining a temperature of a plurality of cutting tools disposed exteriorly on the cutting rotor; and comparing the temperature of the plurality of cutting tools as determined with a rated operating temperature of the cutting tools.

17. A mobile milling machine comprising:

a machine frame supported on a plurality of propulsion devices for travel over a work surface;

a cutting rotor supported by the machine frame and rotatable about a rotor axis for milling the work surface, the cutting rotor includes a cylindrical drum and a plurality of cutting tools exteriorly disposed on the cylindrical drum;

a rotor enclosure attached to the machine frame and accommodating the cutting rotor therein;

a liquid spray system disposed in the rotor enclosure and including a plurality of spray nozzles configured to spray a liquid toward the cutting rotor, the plurality of spray nozzles disposed along one or more spray bars aligned generally parallel with the rotor axis and that are segmented into a plurality of spray zones;

a plurality of surface wetness sensors operatively associated with the liquid spray system and with at least one of each of the plurality of surface wetness sensors aligned with at least one of each of the plurality of spray zones; and an electronic controller in electronic communication with the plurality of surface wetness sensors and the liquid spray system, the electronic controller in cooperation with the plurality of surface wetness sensors configured to determine a wetness of the work surface rearward of the cutting rotor after milling the work surface, the electronic controller programmed to adjust a spray quantity of the liquid delivered by the liquid spray system toward the cutting rotor based on the wetness of the work surface as determined after milling.

* * * * *